US006267639B1

(12) United States Patent
Menow et al.

(10) Patent No.: US 6,267,639 B1
(45) Date of Patent: Jul. 31, 2001

(54) CANDY DISPENSER HAVING AN OSCILLATING PORTION AND PRODUCING SIMULATED LAUGHING SOUNDS

(75) Inventors: Steven M. Menow, Fairfield; David A. Fuhrer, Los Angeles, both of CA (US)

(73) Assignee: OddzOn, Inc., Pawtucket, RI (US)

( * ) Notice: Subject to any disclaimer, the term of this patent is extended or adjusted under 35 U.S.C. 154(b) by 0 days.

(21) Appl. No.: 09/422,299

(22) Filed: Oct. 21, 1999

Related U.S. Application Data

(63) Continuation of application No. 09/244,584, filed on Feb. 4, 1999, now abandoned.

(51) Int. Cl.[7] ..... A63H 5/00; A63H 3/28; A63H 33/30

(52) U.S. Cl. ..... 446/81; 446/303; 446/475; 221/152

(58) Field of Search ..... 446/81, 75, 76, 446/297, 298, 300, 303, 404, 416, 417, 475, 397; 221/152, 151

(56) References Cited

U.S. PATENT DOCUMENTS

| | | | | |
|---|---|---|---|---|
| 2,940,755 | | 6/1960 | Pouder . | |
| 3,132,864 | | 5/1964 | Glass et al. . | |
| 3,153,871 | | 10/1964 | Semba . | |
| 3,460,838 | | 8/1969 | Greenlee, Jr. . | |
| 4,806,909 | | 2/1989 | Arcand . | |
| 4,976,376 | | 12/1990 | Williams . | |
| 4,979,925 | | 12/1990 | Bergersen . | |
| 5,040,673 | | 8/1991 | Huang et al. . | |
| 5,054,782 | | 10/1991 | Sutter . | |
| 5,141,464 | | 8/1992 | Stern et al. . | |
| 5,181,877 | | 1/1993 | Perkitny . | |
| 5,236,385 | * | 8/1993 | May | 446/300 |
| 5,385,267 | | 1/1995 | Diamond et al. . | |
| 5,413,516 | | 5/1995 | Lam . | |
| 5,459,278 | * | 10/1995 | Hsu | 446/298 X |
| 5,510,571 | * | 4/1996 | Huang et al. | 446/298 X |
| 5,571,979 | * | 11/1996 | Chen | 446/298 X |
| 5,651,475 | | 7/1997 | Fenton . | |
| 5,704,789 | | 1/1998 | Yang . | |
| 5,800,243 | * | 9/1998 | Berman | 446/297 X |
| 5,980,355 | * | 11/1999 | Shih | 446/298 |

OTHER PUBLICATIONS

Two drawings illustrating a noise making pen device.

Two drawings illustrating a noise making device having pivoting head resting on a reciprocating rod.

* cited by examiner

*Primary Examiner*—D. Neal Muir
(74) *Attorney, Agent, or Firm*—Marshall, O'Toole, Gerstein, Murray & Borun

(57) ABSTRACT

A candy container or dispenser having a sound generating device and having an oscillating member protruding from an aperture is disclosed. The candy dispenser comprises a housing adapted for attachment to a candy container, with the housing defining an internal cavity and including an aperture. A member is pivotally mounted to the housing and protrudes from the aperture. A gear mechanism is disposed within the housing cavity and includes a rotatable wheel having an irregular peripheral surface. The gear mechanism is operatively connected to the member and includes an actuating trigger. A reed is mounted within the cavity and has an end contacting the peripheral surface, so that upon actuation of the trigger the gear mechanism imparts rotational movement to the wheel thereby causing the reed to produce a sound in response to contact with the wheel peripheral surface. At the same time, the member oscillates about its pivot point. The gear mechanism may be operatively connected to a dispensing mechanism to dispense candy upon the operation of the gear mechanism.

27 Claims, 9 Drawing Sheets

CANDY DISPENSER HAVING AN OSCILLATING PORTION AND PRODUCING SIMULATED LAUGHING SOUNDS

This is a Continuation of U.S. application Ser. No. 09/244,584 now abandoned, filed Feb. 4, 1999.

FIELD OF THE INVENTION

The present invention relates to an apparatus having a gear mechanism that drives a sound generating device, operates a candy dispensing mechanism, and oscillates one or more simulated body members.

BACKGROUND AND SUMMARY OF THE INVENTION

Candy dispensers are generally well known in the art and come in a wide variety of shapes and sizes. It is safe to assume that a relatively high percentage of candy purchases are made by (or at least at the direction of) children. However, the typical child has little if any brand loyalty, and thus candy manufacturers have long relied on clever packaging in order to attract the purchaser's attention. One marketing approach has been to put the candy in an attractive candy dispenser designed to appeal to children and/or adults. For example, many members of the public can recall the very popular Pez® candy dispensers. Other candy packages rely on the use of licensed cartoon characters, action figures, or even the name of a popular sports personality. Thus, it is a commonly held belief that a candy container or dispenser that incorporates one or more novel or unique features is very likely to significantly increase the sales of that candy product. Therefore, there is a continuing need for novel candy containers and dispensers.

According to one aspect of the present invention, a candy dispenser includes a housing defining an internal cavity and being adapted to hold a candy container. The housing includes an opening, and a member is pivotally mounted to the housing and protrudes from the aperture. A gear mechanism operatively connected to the member is disposed within the housing cavity and includes an actuating trigger and a rotatable wheel having an irregular peripheral surface. A reed is mounted within the cavity and has an end which contacts the peripheral surface of the wheel. Upon actuation of the trigger the gear mechanism imparts rotational movement to the rotatable wheel, thereby producing a sound as the reed vibrates upon contact with the irregular peripheral surface of the wheel. Movement of the gear mechanism also causes the member to oscillate.

In further accordance with a preferred embodiment of the invention, the gear mechanism includes a flywheel adapted to impart enhanced rotational momentum to the gear mechanism. A connecting rod is eccentrically connected to the rotatable wheel and engages the member. The connecting rod thus reciprocates in response to rotation of the rotatable wheel which oscillates or pivots the member about its pivot. Preferably, the reed is mounted to or mounted adjacent to a mylar member or disc in order to enhance the sound generated by the reed.

The trigger is pivotally mounted to the housing and is shiftable between a first position and a second position. The trigger is adapted to actuate the gear mechanism in response to movement of the trigger from the first position toward the second position, and includes a return spring for biasing the trigger toward the first position.

The trigger also includes an arcuate drive rack and the gear assembly includes a pinion. The drive rack engages the pinion to in order to impart rotational movement to the pinion in response to movement of the trigger toward the second position. When the pinion rotates the gear mechanism, the reciprocating motion of the connecting rod second end causes the tongue to pivot about a pivot point.

The gear mechanism preferably includes a clutch, with the clutch separating the gear mechanism into a first portion and a second portion. The clutch is adapted to permit continued rotation of the second portion of the gear mechanism as the trigger is moved from the second position toward the first position. A flywheel, which is preferably mounted to the gear mechanism second portion, is included in order to impart enhanced rotational momentum to the gear mechanism.

The device may be combined with a candy container adapted to hold candy. The candy container includes a dispensing opening, and the device further includes a shiftable valve member mounted to the candy container adjacent to the dispensing opening, with the valve member being operatively connected to the gear mechanism. Accordingly, in response to the operation of the gear mechanism the valve member shifts between a closed position and an open position. The valve member in the open position permits the passage of candy from the candy container through the dispensing opening. The valve member is preferably connected to a rocker arm pivotally mounted to the candy container adjacent to the dispensing opening, and the valve member may include a slide portion slidably disposed in the candy container such that the slide member slides back and forth as the rocker arm shifts the valve member between the open and closed positions. The slide portion includes an exit opening which is generally offset from the dispensing opening when the valve member is in the closed position. The slide portion exit opening is generally aligned with the dispensing opening when the valve member is in the open position.

In accordance with another aspect of the invention, a device for dispensing candy includes a housing having an internal cavity and including a top portion having an aperture. A member, such as a simulated tongue, is mounted to a pivot and protrudes from the aperture, and a gear mechanism is disposed within the housing cavity and includes a rotatable wheel having an irregular peripheral surface. The gear mechanism is operatively connected to the protruding member and includes an actuating trigger. A sound generating member, such as a reed, is mounted within the cavity and includes an end positioned to contact the wheel peripheral surface. In response to movement of the actuating button rotational movement may be imparted to the gear mechanism. The rotational movement of the wheel causes the sound generating member to produce a sound in response to contact with the rotating wheel and further causes the protruding member to reciprocate about the pivot.

In accordance with another aspect of the invention, a device for use with a candy dispenser comprises a housing having an aperture and defining an internal cavity, with the housing being adapted for attachment to the candy container. A pivoting member is mounted to the housing and protrudes from the aperture. A gear mechanism is disposed within the housing cavity and includes a rotatable wheel having an irregular peripheral surface. The gear mechanism is operatively connected to the pivoting member and includes an actuating trigger adapted to impart rotational movement to the gear mechanism. A reed is mounted within the cavity and includes an end in contact with the wheel peripheral surface. In response to rotational movement of the gear mechanism the moveable member oscillates while the relative movement between the reed and the wheel irregular peripheral surface generates a sound.

According to a still further aspect of the invention, a candy dispensing device includes a housing defining an internal cavity and a candy container connected to the housing and having a dispensing opening. A gear mechanism is disposed within the housing cavity, and a trigger is mounted to the housing and is adapted to operate the gear mechanism. A shiftable valve member is mounted to the candy container adjacent to the dispensing opening and is operatively connected to the gear mechanism. In response to the operation of the gear mechanism the valve member shifts between a first position in which the valve member prevents the passage of candy through the dispensing opening, and a second position in which the valve member permits the passage of candy from the candy container through the dispensing opening.

According to yet another aspect of the invention, a candy dispensing device includes a housing defining an internal cavity, a candy container connected to the housing and having a dispensing opening, a gear mechanism disposed within the housing cavity, a trigger mounted to the housing and being adapted to operate the gear mechanism, and candy delivery means for delivering candy from the container. The candy delivery means are operatively coupled to the gear mechanism so as to be responsive to operation of the gear mechanism.

The aforementioned features and advantages, in addition to other features and advantages, will become readily apparent to those skilled in the art upon a reading of the following detailed description.

DETAILED DESCRIPTION OF THE PREFERRED EMBODIMENT

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 1:
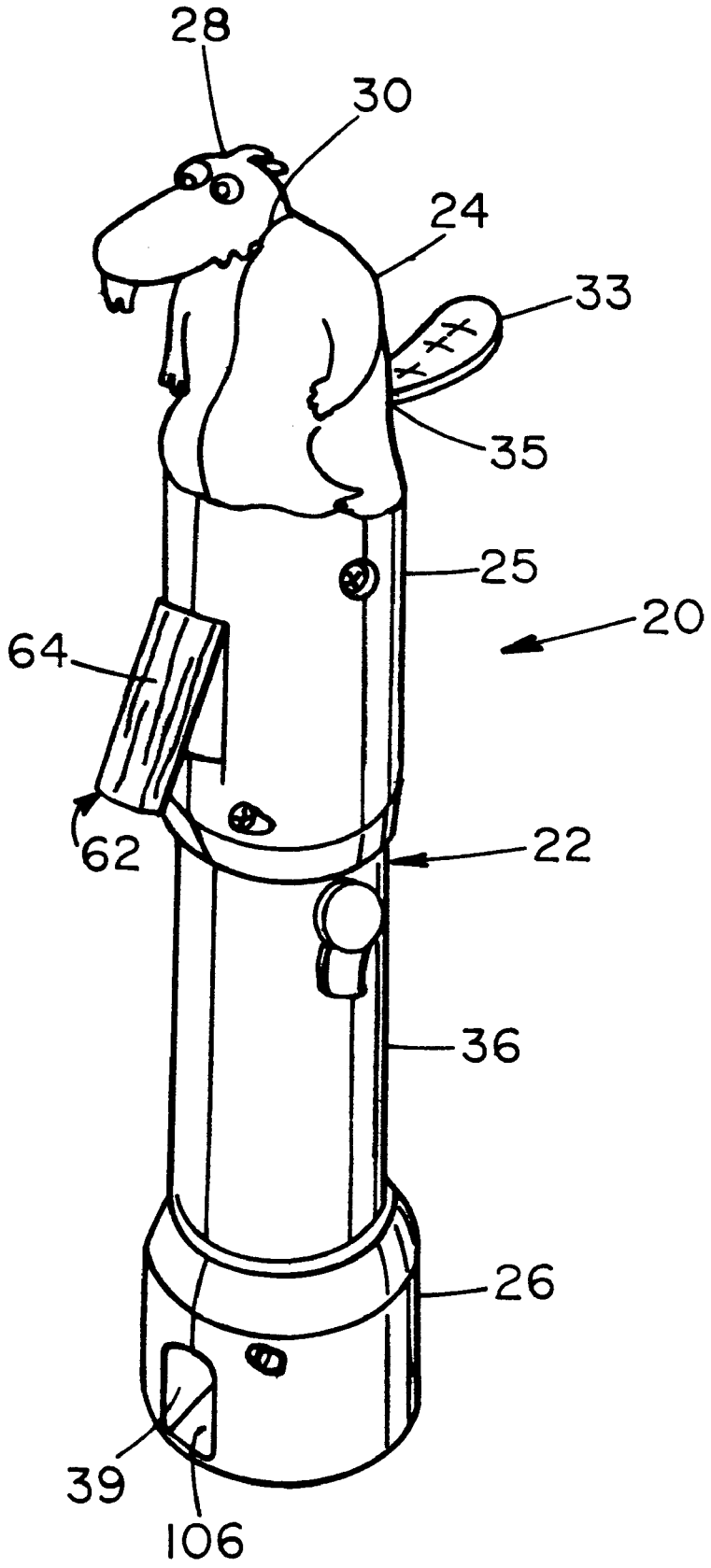
FIG. 1 is a perspective view of a candy dispenser constructed in accordance with the teachings of the present invention.
Figures 2, 2A:
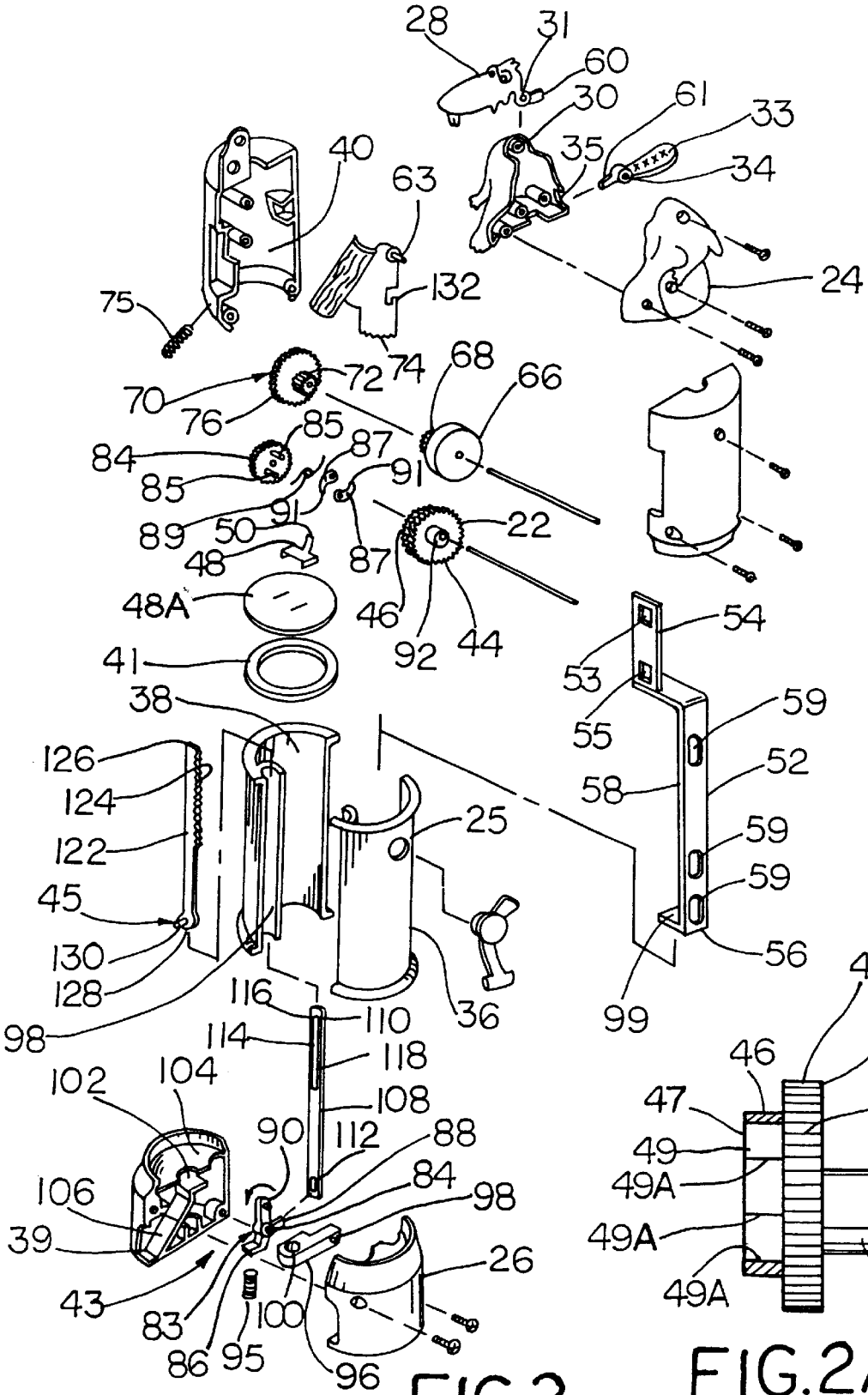
FIG. 2 is an exploded view in perspective of the candy dispenser illustrated in FIG. 1.
FIG. 2A is an enlarged fragmentary elevational view, partly in section, of the rotatable wheel.

Referring now to the FIGS. 1 and 2 of drawings, a candy dispenser constructed in accordance with the teachings of the present invention is generally referred to by the reference numeral 20. The candy dispenser 20 includes a housing 22 having an upper portion 24, a middle portion 25, and a lower portion 26. A simulated head 28 is mounted to the upper portion 24 (and preferably extending through an aperture 30 in the upper portion 24), and is mounted within the housing 22 by a pivot 31. Alternatively, the head 28 may be pivotally mounted to the exterior of the housing 22 in a similar manner. Another simulated body part such as a tail 33 protrudes from another aperture 35 and is also mounted to a pivot 34.

A candy container 36 is mounted below the middle portion 25 and includes an internal cavity 38 adapted to hold a plurality of candy items 37 or other articles. The container 36 is preferably formed of clear ABS plastic, and includes a refill opening. The lower portion 26 includes a candy dispensing opening 39 which communicates with the cavity 38 as will be explained in greater detail below.

As shown in FIGS. 2 through 6 of the drawings, the upper portion 24 and the middle portion 25 of the housing 22 enclose an internal cavity 40. A gear mechanism 42 is mounted to the housing 22 substantially within the confines of the cavity 40. Preferably, certain portions of the device 20 (for example, each of the upper portion 24, the middle portion 25, the candy container 36 and the lower portion 26 of the housing 22) may be formed in two halves or portions according to commonly employed molding techniques using ABS plastic or other suitable materials. The two portions are joined in a manner well known to those skilled in the art. An O-ring member 41 is provided at the interface between the cavity 38 of the candy container 36 and the cavity 40. A candy dispensing mechanism 43 is mounted within the lower portion 26 of the housing 22 and is connected to the gear mechanism 42 by a linkage assembly 45.

The gear mechanism 42 includes a wheel 44 having an irregular outer surface 46. A reed 48 is mounted within the cavity 40 and is disposed such that an end 50 of the reed 48 is disposed adjacent to and touching the irregular outer surface 46 of the wheel 44 (note that in each of FIGS. 4 and 6 the end 50 of the reed 48 is obscured from view by other portions of the gear mechanism 42). The reed is preferably a thin metallic member, although other materials may also be suitable. In response to the rotation of the wheel 44 in a manner to be outlined in greater detail below, the reed 48 will vibrate and produce a sound. Preferably, the reed 48 is mounted to a mylar disc 48A, which is disposed immediately above the O-ring 41. As outlined below, the reed 48, upon vibrating, produces a sound such as a simulated laughing sound. The mylar disc 48*a* enhances the sound produced by the vibration of the reed 48.

Figure 4:
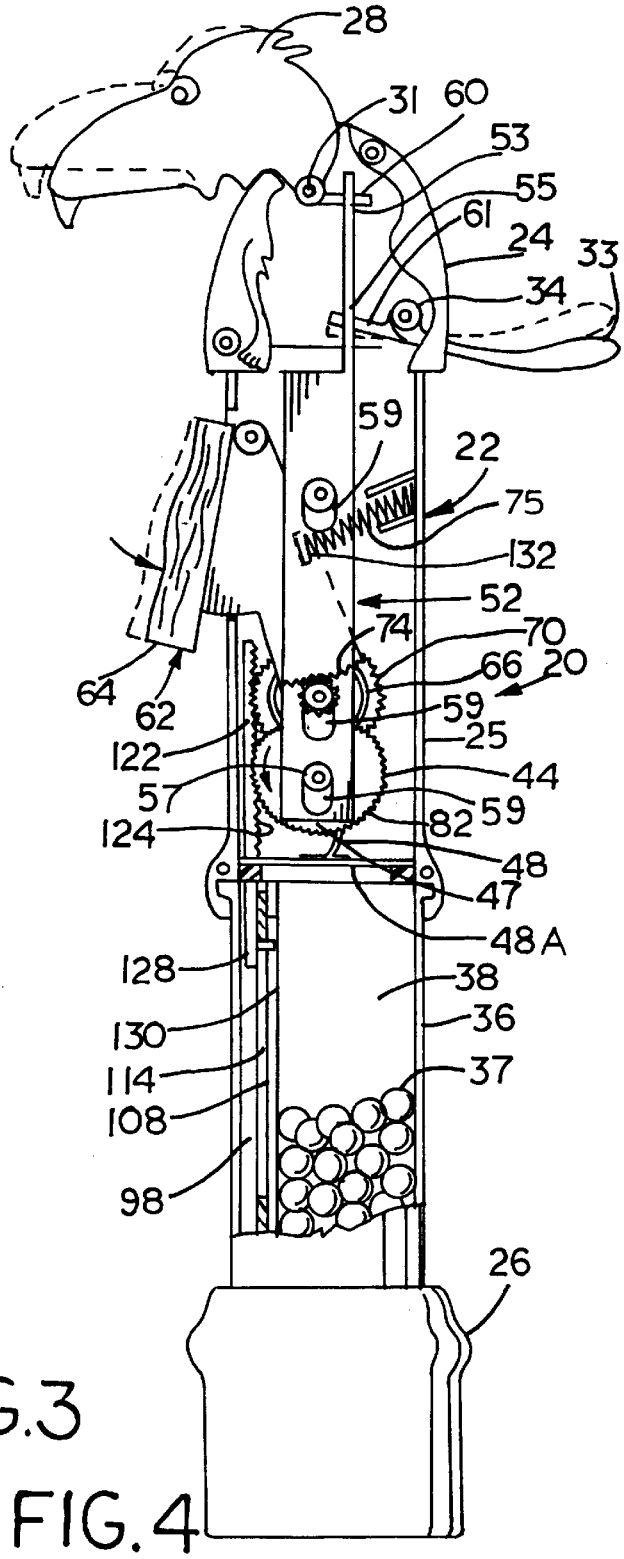
FIG. 4 is an enlarged side elevational view, partly in section, of the candy dispenser shown in FIGS. 1 through 3 and showing the pivoting member in a first position.
Figure 6:
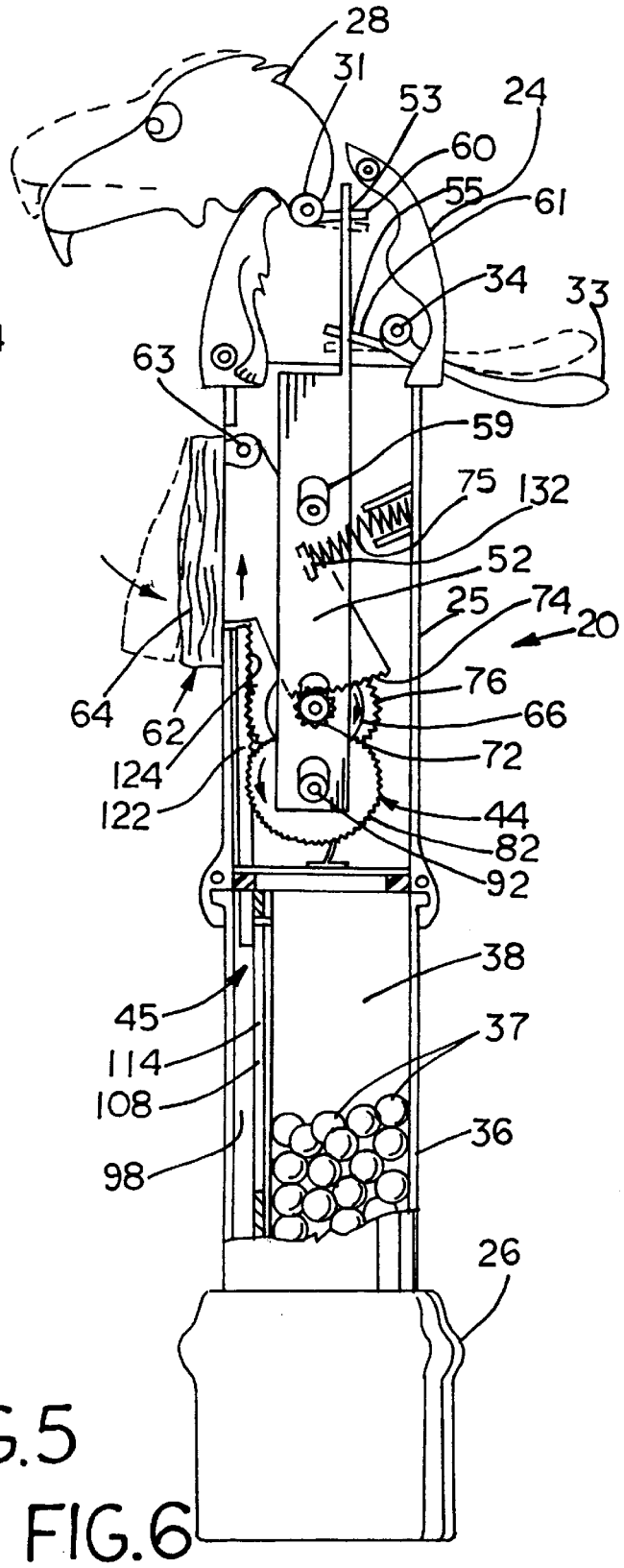
FIG. 6 is an enlarged side elevational view, partly in section, similar to FIG. 4 but showing the pivoting member in the second position.
Figure 7:
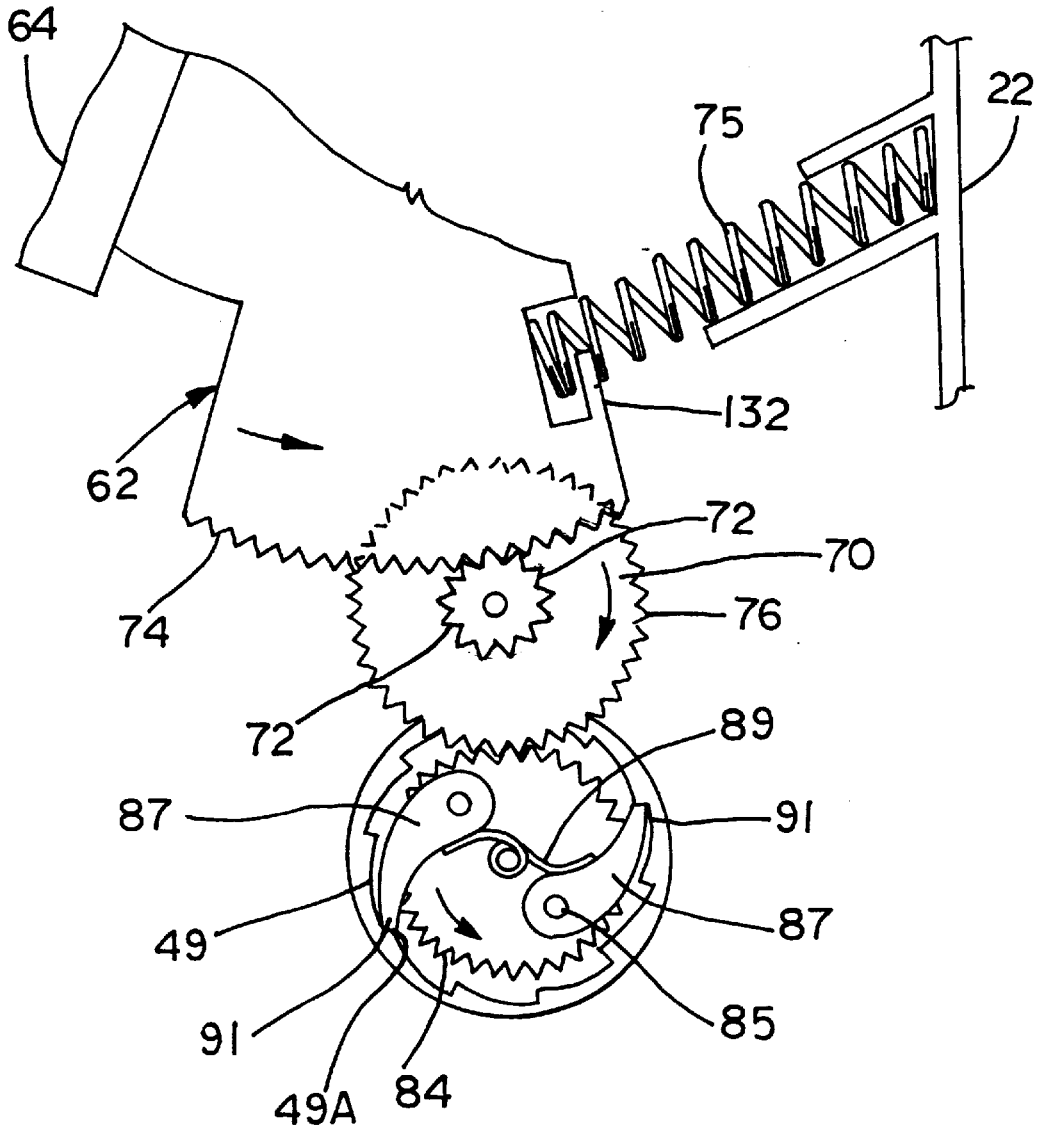
FIG. 7 is an enlarged fragmentary view of the trigger engaging portions of the gear mechanism.

A connecting rod 52 having a pair of ends 54, 56 and an interconnecting shank 58 is mounted to the housing 22 inside the cavity 40. The connecting rod includes a pair of slots 53, 55. As shown in FIGS. 2, 4 and 6, the slot 53 is engaged by an extension 60 of the head 28, while the slot 55 is engaged by an extension 61 of the tail 33. The end 56 of the connecting rod 52 is connected to the gear mechanism 42 by an eccentric connection 57 as outlined in greater detail below. A trigger 62 is connected to the gear mechanism 42, and includes a handle portion 64 which protrudes from the housing 22. The trigger 62 is mounted to a pivot 63 and is shiftable between an outward or first position, such as is shown in FIG. 1, and an inward or second position, such as is shown in FIG. 4, 6 or 7. Alternatively, the trigger 62 could be a reciprocating or sliding trigger rather than a pivoting trigger.

Figure 5:
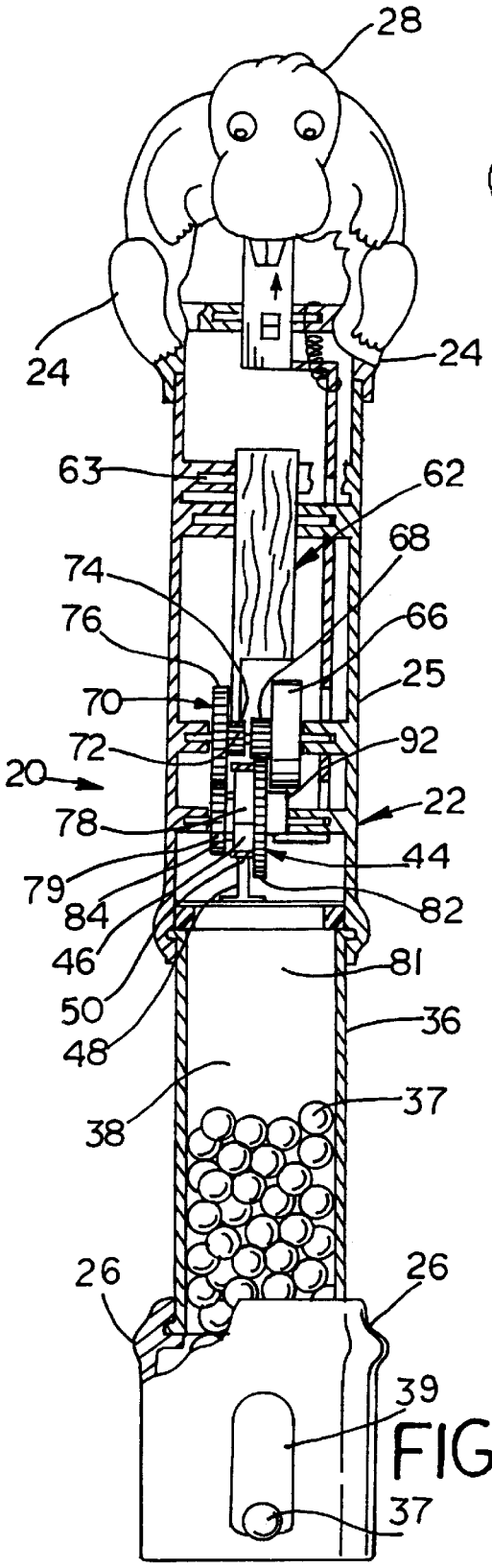
FIG. 5 is an enlarged front elevational view, partly in section, similar to that shown in FIG. 3 but showing the tongue in a second position.

In a manner that will be explained in greater detail below, the trigger 62 operatively engages the gear mechanism 42 so as to impart rotational movement to portions of the gear mechanism 42, which causes the wheel 44 to rotate. In the process, the reed 48 vibrates by virtue of its contact against the irregular outer surface 46 of the wheel 44 as shown in FIGS. 4, 5 and 6, thus creating an audible sound. In the preferred embodiment, the audible sound simulates a laughing sound, although the creation of other sounds may also be contemplated. At the same time, the connecting rod 52 reciprocates in a generally vertical direction by virtue of its eccentric connection 57 to the gear mechanism 42. As the connecting rod 52 reciprocates, the slots 53 and 55 engaging the extensions 60, 61, respectively, cause the head 28 and the tail 33 to oscillate about their respective pivots.

Referring now to FIG. 2 through FIG. 6, the gear mechanism 42 includes a flywheel 66 which is rotatably mounted within the cavity 40 in a conventional manner. The flywheel 66 includes a driven gear 68. As would be known to one skilled in the art, the flywheel 66 is relatively heavy in order to impart rotational momentum to the gear mechanism 42. The gear mechanism 42 also includes a gear 70 having a pinion 72 and an outer gear 76. The pinion 72 engages a toothed drive rack 74 on the trigger 62.

A gear 84 engages the outer gear 76 of the gear 70. The gear 84 includes a pair of posts 85, each of which has pivotally mounted thereon a latch lever 87. A one or more springs 89 are provided for biasing the levers 87 in an outward direction as will be explained in further detail below. The gear 84, the wheel 44 and the levers 87 may be formed from Delrin plastic.

The wheel 44 includes a first side 47 having a recessed gear 49 and also includes a second side 51 as shown on FIG. 2A. The posts 85, the levers 87, the springs 89, and the recessed gear 49 together form a clutch assembly 78. The clutch assembly 78 operatively connects the gear 70 to the wheel 44, and effectively divides the gear mechanism into a first portion 79 (consisting of the gears 70 and 84) and a second portion 81 (consisting of the wheel 44 and the flywheel 66. The clutch assembly 78 permits the gear 70 to drive the wheel 44. The wheel 44 also includes an outer gear 82 which engages the driven gear 68 on the flywheel 66. Each of the above described components is rotatably mounted to the housing 22 in a conventional manner. Also, it will be appreciated that the gear 70 and the flywheel 66, despite their close proximity, are capable of rotating independently of each other.

Figure 8:
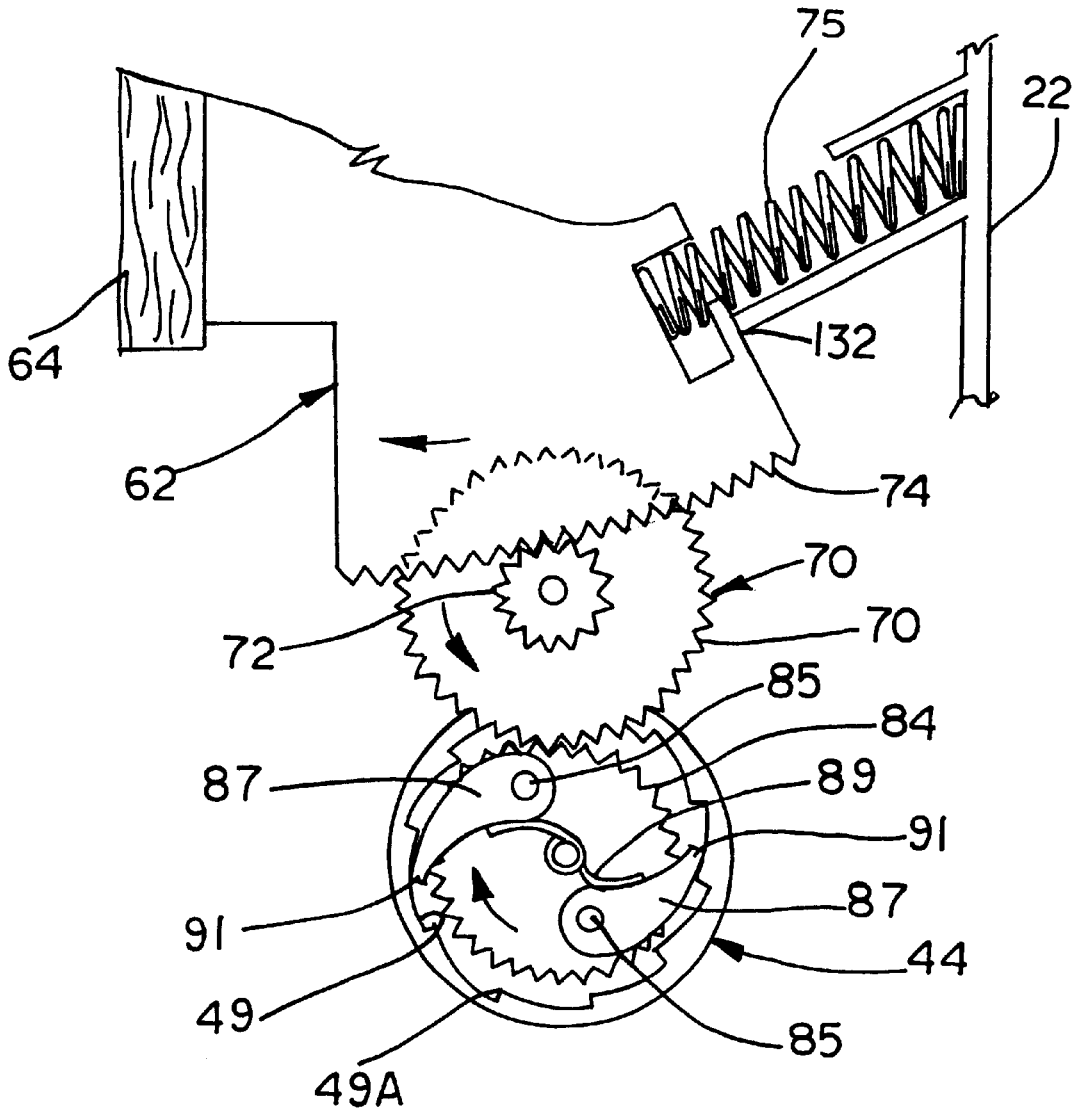
FIG. 8 is an enlarged fragmentary view similar to FIG. 7 but showing the trigger being retracted and the clutch in a freewheel mode.
Figure 9:
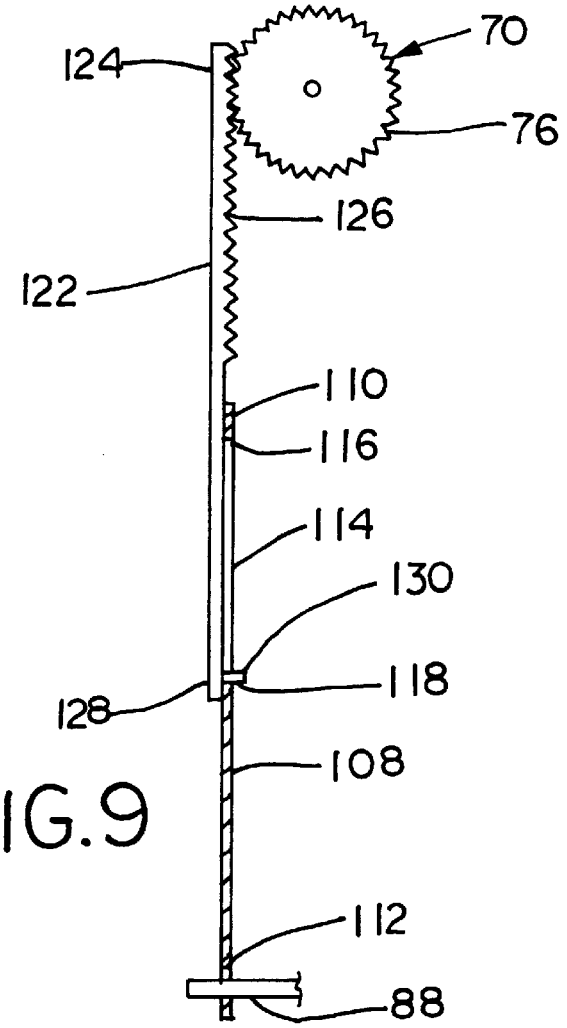
FIG. 9 is a fragmentary elevational view of the linkage assembly connecting the gear mechanism to the dispensing mechanism with the linkage assembly being shown in a retracted mode.

Referring now to FIG. 7 and 8, as outlined above the clutch assembly 78 permits the gear 84 to drive the wheel 44 in response to rotation of the gear 70 imparted upon actuation of the trigger 62. Each of the levers 85 includes an outer tooth 91 adapted to engage the teeth 93 on the recessed gear 49, so that the gear 84 and the wheel 44 are rotated in the same direction upon actuation of the trigger as shown in FIG. 7. In other words, when the drive mechanism 42 is activated by depressing the trigger 62, the toothed rack 74 on the trigger 62 engages the outer gear 76 of the gear 70, which in turn drives the gear 84. In the process, the outer teeth 91 on each of the outwardly biased levers 87 engage the plurality of annular teeth 49*a* on the recessed gear 49 of the wheel 44, so that the wheel 44 is driven in the same direction as the gear 84 (counterclockwise when viewing FIG. 7). When the trigger 62 is retracted as shown in FIG. 8 (preferably by the aid of a return spring 75), the clutch assembly 78 decouples or operatively disengages the trigger 62 and the gear 70 from the rest of the gear mechanism 42. The return spring 75 may be positioned as shown in FIG. 7 or 8, or alternatively may abut other portions of the trigger 62 as would be known to those skilled in the art. As shown, the gear wheel 44 continues to rotate in the counterclockwise direction while the gear 84 clockwise as the trigger 62, returning to its original position, rotates the gear 70 counterclockwise. Accordingly, the second portion 81 of the gear mechanism 42, aided by the rotational momentum imparted by the flywheel 66, continues to rotate.

Figure 3:
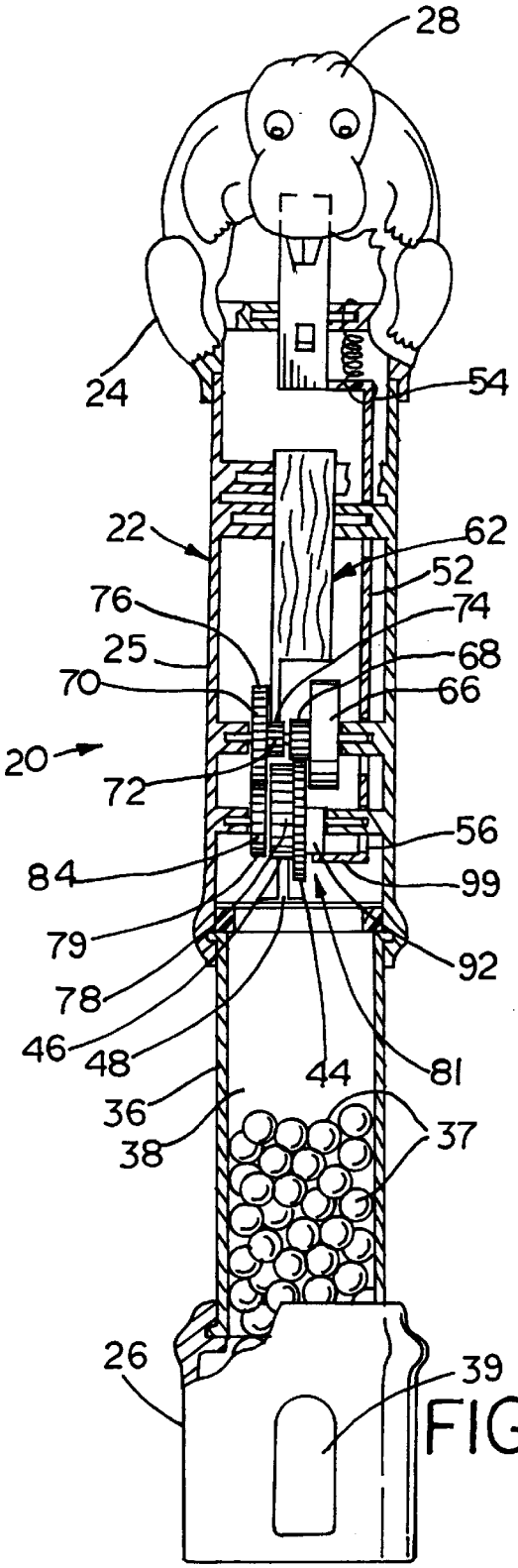
FIG. 3 is an enlarged front elevational view, partly in section, of the candy dispenser shown in FIGS. 1 and 2.

Referring now to FIGS. 2 through 4, the eccentric connection 57 includes an eccentric cam lobe 92 mounted for rotation with the drive gear 82 attached to the wheel 44. The end 56 of the connecting rod 52 includes a cam follower 94. The rod 52 also includes one or more guide slots 59 to guide the rod 52 along a generally linear path. Preferably, the connecting rod 52 includes a return spring 98 to ensure that the cam follower 94 stays in contact with the cam lobe 92.

Figure 10:
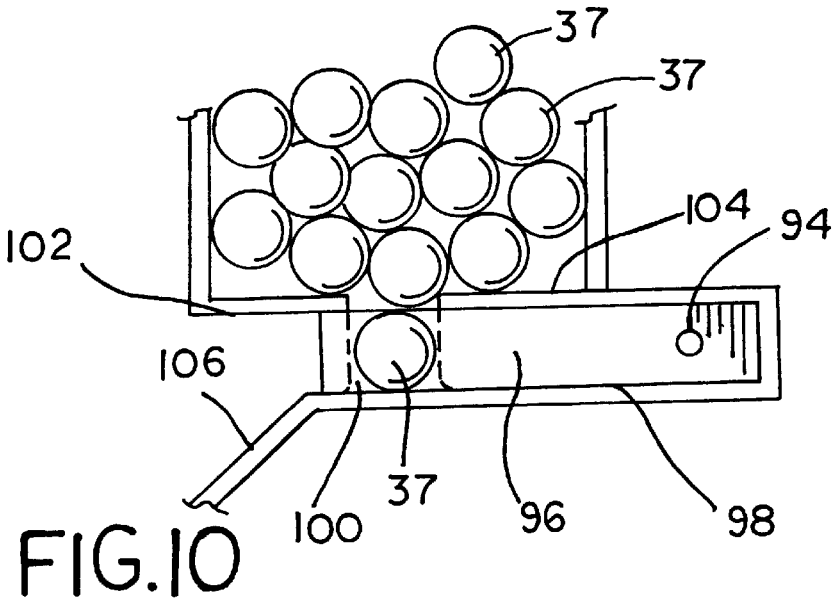
FIG. 10 is an enlarged fragmentary cross-sectional view of portions of the candy dispensing mechanism.
Figure 11:
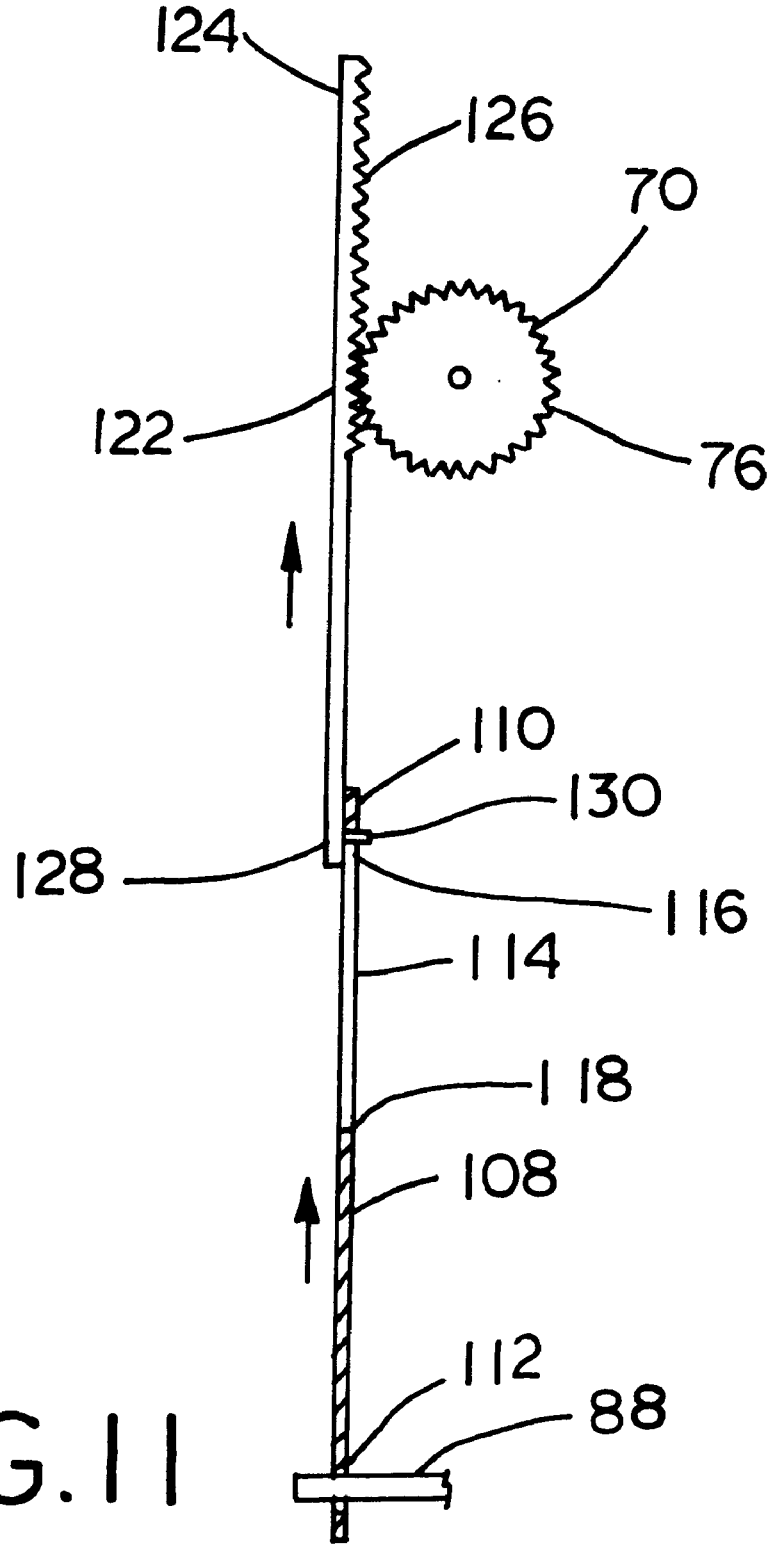
FIG. 11 is an enlarged fragmentary cross-sectional view similar to FIG. 9 but showing the linkage assembly in a partially extended mode.
Figure 12:
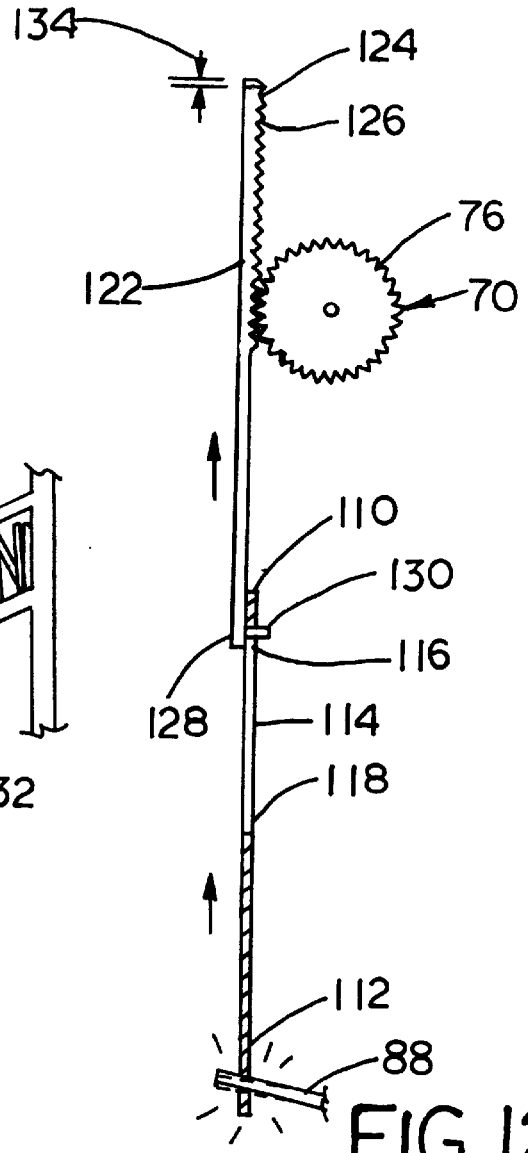
FIG. 12 is an enlarged fragmentary cross-sectional view similar to FIGS. 9 and 11 but illustrating the linkage assembly in a fully extended position.
Figure 13:
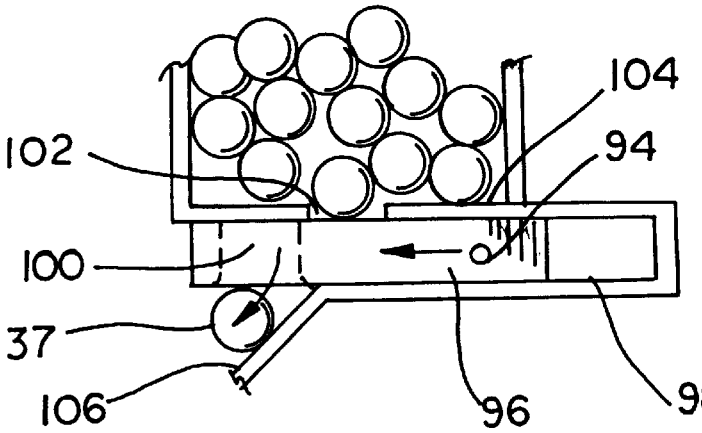
FIG. 13 is an enlarged fragmentary cross-sectional view similar to FIG. 10 but illustrating the candy dispensing mechanism in an operative position.

Referring now to FIGS. 2 and 9 through 14, the dispensing assembly 43 includes a rocker arm 83 mounted by a pivot 84 to the lower portion 26 of the housing 22. The rocker arm includes three arms 86, 88 and 90. A return spring 95 is preferably provided for biasing the rocker arm in a clockwise direction when viewing FIG. 2 by applying an upward biasing force on the arm 86. The arm 90 includes a post 92 which engages an aperture 94 in a slide valve 96. The slide valve 96 is mounted in a horizontal guide 98 defined in the lower portion 26 of the housing 22. As shown in FIG. 10, the slide valve 96 includes a port or opening 100 which is aligned with an opening 102 in a bottom wall 104 of the candy container 36 when the dispensing assembly 43 is inoperative. In response to the operation of the linkage assembly 45 as outlined below, the rocker arm 83 will pivot about the pivot 84. When viewing FIG. 2, upward movement of rod 108 (which occurs only upon the full extension of the linkage assembly 45 as shown in FIG. 12) causes the rocker arm to pivot in a counterclockwise direction. In so doing, the slide valve 96 will move laterally within the guide 98 such that the opening 100 will be disposed over a ramp 106 as shown in FIG. 13, such that a piece of candy disposed in the opening 100 will fall onto the ramp 106 and exit the container 36 through the dispensing opening 39. It will be understood that the rod 122 rises and falls with each pull and release of the trigger 62, while the rod 108 will remain stationary unless the linkage assembly is fully extended. The return spring 95 will maintain the dispensing assembly 43 in an inoperative position unless activated by the linkage assembly as above-described.

Figure 14:
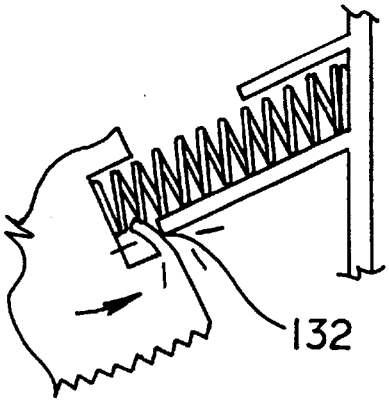
FIG. 14 is an enlarged fragmentary cross-sectional view of a portion of the trigger assembly showing the trigger in a position to fully extend the linkage assembly.

Referring now to FIGS. 2 and 9–14, the linkage assembly 45 includes a lower rod 108 having an upper end 110 and a lower end 112. The upper end 110 includes a slot 114 having an upper end 116 and a lower end 118, while the lower end 112 engaging the arm 88 of the rocker arm 83. The linkage assembly 45 also includes an upper rod 122 having an upper end 124 having a toothed rack 126 engaging the outer gear 76 of the gear 70, and also includes a lower end 128 having a pin 130 engaging the slot 114. Portions of the rods 108 and 122 are disposed in a guide housing 132 defined in a portion of the candy container 36. Both rods 108 and 122 are preferably formed of Delrin plastic. It will be appreciated that the rods 108 and 122 are relatively moveable. For example, as the trigger 62 is moved back and forth, the upper rod 122 will slide up and down with the pin 130 sliding within the slot 114 between the retracted position of FIG. 9 and the partially extended position of FIG. 11. As shown in FIGS. 12 and 14, the trigger 62 includes a resilient arm 132, which, upon extra pressure being applied to the trigger 62, deflects slightly thus allowing the linkage assembly 45 to be fully extended (by an additional measure 134), such that the arm 88 of the rocker arm 83 is moved. Consequently, the movement of the rocker arm 83 causes the slide valve 96 to slide back and forth between the position of FIG. 10 and the position of FIG. 13.

In operation, the candy dispenser 20 is held in the hand of a user (not shown). The user activates the candy dispenser 20 by pressing on the handle portion 64 of the trigger 62 such that the trigger 62 moves from the first position shown in FIG. 1, toward the second position, such as is shown in FIGS. 4, 6 and 7. The toothed rack 74 engages the pinion 72 of the gear 70, thus commencing the rotation of the gear mechanism 42.

As shown in FIGS. 7 and 8, the toothed rack 74 causes the gear 70 to rotate in the clockwise direction, with the outer gear 76 causing the gear 84 to rotate in the opposite (i.e., counterclockwise) direction. The spring 89 forces the teeth 91 of the levers 87 to engage the teeth 49*a* in the recessed gear 49 on the wheel 44. Consequently, the wheel 44 rotates in the same direction as the gear 84. As the wheel 44 thus rotates, the end 50 of the reed 48 contacts the irregular outer surface 46, which thus causes the reed 48 to vibrate and produce an audible noise. The drive gear 82 drives the gear 68 on the flywheel 66, thus rotating the flywheel 66 in a generally clockwise direction when viewing FIG. 2. It will be understood to those skilled in the art that additional idler gears (not shown) could be used.

As the wheel 44 rotates, the cam lobe 92 is engaged by the cam follower 99 on the rod 52, which causes the rod 52 to reciprocate up and down. In the process, the head 28 and the tail 33 pivot or oscillate about their respective pivots.

Once the trigger 62 has been depressed to the position of FIG. 8, the operator may user can release the trigger 62 which is then returned toward the first position as shown in FIG. 8. By virtue of the clutch assembly 78, the trigger 62, the gear 70, and the gear 84 are decoupled or operatively disconnected from the balance of the gear mechanism 42. This decoupling permits the balance of the gear mechanism 42 (the wheel 44 and the flywheel 66) to continue to rotate in the manner described above, aided by the rotational momentum of the flywheel 66. When decoupled, the teeth 91 on the levers 87 pivot about the posts 85 and thus slide over the teeth 49*a*, so that the first portion 79 of the mechanism 42 offers little or no resistance to the continued rotation of the second portion 81 of the mechanism 42. Accordingly, the rest of the gear mechanism 42 continues to rotate so that the sound produced by the reed 48 continues, and so that the head 28 and the tail 33 continue to oscillate by virtue of the reciprocating connecting rod 52. Once the rotational momentum of the flywheel 66 is exhausted, the gear mechanism 42 will come to a stop.

When it is desired to dispense a piece of candy items 37 from the opening 39, the operator pulls the trigger 62 an extra measure as shown in FIG. 14 to deflect the arm 132, which thus allows the linkage assembly 45 to be fully extended. Consequently, the arm 88 pivots the rocker arm 86, causing the slide valve 96 to slide within the guide 98 such that a candy item 37 drops through the opening 100 onto the ramp 102, from where the candy item 37 slides through the dispensing opening 39. Preferably, only a single piece of candy 37 will be delivered upon moving the trigger through a full actuation cycle (i.e., all the way to the position of FIG. 14).

It will be understood that the above description does not limit the invention to the above-given details. It is contemplated that various modifications and substitutions can be made without departing from the spirit and scope of the following claims.

What is claimed:

1. A device for use with a candy container, the device comprising:

a housing adapted for attachment to the candy container, the housing defining an internal cavity and including a pair of apertures;

a pair of members pivotally mounted to the housing, each of the pair of members protruding from a corresponding one of the apertures;

a gear mechanism disposed within the housing cavity and including a rotatable wheel having an irregular peripheral surface, the gear mechanism being operatively connected to each of the members;

an actuating trigger; and a reed mounted within the cavity and having an end contacting the rotatable wheel peripheral surface;

whereby upon actuation of the trigger the gear mechanism imparts rotational movement to the wheel thereby causing the reed to produce a sound in response to contact with the wheel peripheral surface and further causing the members to oscillate.

2. The device of claim 1, wherein the gear mechanism includes a flywheel, the flywheel being adapted to impart enhanced rotational momentum to the gear mechanism.

3. The device of claim 1, wherein the gear mechanism is operatively connected to each of the members by a connecting rod, the connecting rod being eccentrically connected to the rotatable wheel.

4. The device of claim 1, wherein the trigger is pivotally mounted to the housing, the trigger being shiftable between a first position and a second position, the trigger being adapted to actuate the gear mechanism in response to movement from the first position toward the second position.

5. The device of claim 4, including a return spring for biasing the trigger toward the first position.

6. The device of claim 4, wherein the trigger includes an arcuate drive rack and the gear assembly includes a pinion, and wherein the drive rack engages the pinion to thereby impart rotational movement to the pinion in response to movement of the trigger toward the second position.

7. The device of claim 3, wherein the connecting rod includes a pair of slots and each of the members includes an inner portion operatively engaging a corresponding one of the slots, and further wherein the eccentric connection includes a cam lobe.

8. The device of claim 4, wherein the gear mechanism includes a clutch, the clutch separating the gear mechanism into a first portion and a second portion, the clutch being adapted to permit continued rotation of the second portion of the gear mechanism as the trigger is moved from the second position toward the first position.

9. The device of claim 8, wherein the gear mechanism includes a flywheel, the flywheel being adapted to impart enhanced rotational momentum to the gear mechanism.

10. The device of claim 9, wherein the flywheel is operatively connected to the second portion of the gear mechanism.

11. The device of claim 1, in combination with a candy container adapted to hold candy, the candy container including a dispensing opening, and further including a shiftable valve member mounted to the candy container adjacent to the dispensing opening, the valve member being operatively connected to the gear mechanism, whereby in response to operation of the gear mechanism the valve member shifts between a closed position and an open position, the valve member in the open position permitting the passage of candy from the candy container through the dispensing opening.

12. The device of claim 11, wherein the valve member includes a rocker arm pivotally mounted to the candy container adjacent to the dispensing opening, and further wherein the valve member includes a slide portion slidably disposed in the candy container, the slide member being adapted to slide back and forth as the valve member shifts between the open and closed positions.

13. The device of claim 12, wherein the slide portion includes an exit opening, the opening being generally offset from the dispensing opening when the valve member is in the closed position, the exit opening being generally aligned with the dispensing opening when the valve member is in the open position.

14. For use with a candy container, a device comprising:

a housing having an internal cavity and an aperture, the housing being adapted for attachment to the candy container;

a protruding member mounted to the housing by a pivot and protruding from the aperture;

a gear mechanism disposed within the housing cavity and including a rotatable wheel, the rotatable wheel having an irregular peripheral surface, the gear mechanism being operatively connected to the protruding member at a location within the housing;

a shiftable actuating trigger mounted to the housing and engaging the gear mechanism, the actuating trigger being shiftable between a first position and a second position; and a sound generating member mounted within the cavity and having an end contacting the wheel peripheral surface;

whereby rotational movement is imparted to the gear mechanism in response to movement of the actuating button toward the second position, thereby causing the sound generating member to produce a sound in response to contact with the rotating wheel and further causing the protruding member to oscillate about its pivot.

15. The device of claim 14, wherein the gear mechanism is connected to the protruding member by a connecting rod, the connecting rod having a first end engaging the protruding member and further having a second end engaging the gear mechanism.

16. The device of claim 14, wherein the gear mechanism includes a flywheel, the flywheel being adapted to impart enhanced rotational momentum to the gear mechanism.

17. The device of claim 15, wherein the connecting rod includes a first end, the first end including a slot adapted to receive an inner end of the protruding member, and wherein the rotatable wheel is operatively connected to a cam lobe, the connecting rod having a second end engaging the cam lobe.

18. The device of claim 17, wherein the connecting rod includes a second end having a cam follower engaging the cam lobe, and further including a spring adapted to maintain the cam follower in contact with the cam lobe.

19. The device of claim 14, wherein the actuating trigger is pivotally mounted to the housing, the actuating trigger being adapted to actuate the gear mechanism in response to movement from the first position toward the second position.

20. The device of claim 19, including a return spring for biasing the actuating trigger toward the first position.

21. The device of claim 19, wherein the actuating trigger includes an arcuate drive rack and the gear assembly includes a pinion, and wherein the drive rack engages the pinion to thereby impart rotational movement to the pinion in response to movement of the actuating trigger toward the second position.

22. The device of claim 14, wherein the trigger engages the gear mechanism as the trigger is shifted from a first position toward a second position, and further wherein the gear mechanism includes a clutch, the clutch being adapted to permit continued rotation of the gear mechanism as the trigger is moved from the second position toward the first position.

23. A device for use with a candy dispenser, comprising:

a housing having a pair of apertures and defining an internal cavity, the housing being adapted for attachment to the candy container;

a pair of pivoting members mounted to the housing, each of the pair of members protruding from a corresponding one of the apertures;

a gear mechanism disposed within the housing cavity and including a rotatable wheel, the rotatable wheel having an irregular peripheral surface, the gear mechanism being operatively connected to each of the pivoting members;

a trigger adapted to impart rotational movement to the gear mechanism; and a reed mounted within the cavity and having an end contacting the wheel peripheral surface;

whereby in response to rotational movement of the gear mechanism each of the moveable members oscillates while the relative movement between the reed and the wheel irregular peripheral surface generates a sound.

24. The device of claim 23, wherein the trigger is pivotally mounted to the housing and includes a toothed drive rack engaging the gear mechanism.

25. The device of claim 23, wherein the gear mechanism includes a flywheel, the flywheel being adapted to impart enhanced rotational momentum to the rotatable wheel.

26. The device of claim 25, wherein the trigger engages the gear mechanism as the trigger is shifted from a first position toward a second position, and further wherein the gear mechanism includes a clutch, the clutch being adapted to permit continued rotation of a portion of the gear mechanism as the trigger is moved from the second position toward the first position.

27. A device for use with a candy dispenser, comprising:

a housing having a pair of apertures and defining an internal cavity, the housing being adapted for attachment to the candy container, a portion of the housing being adapted to resemble a beaver;

a pair of pivoting members mounted to the housing portion, each of the pair of members protruding from a corresponding one of the apertures, each of the pair of members further being adapted to resemble a body portion of the beaver;

a gear mechanism disposed within the housing cavity and including a rotatable wheel, the rotatable wheel having an irregular peripheral surface, the gear mechanism being operatively connected to each of the pivoting members;

a trigger adapted to impart rotational movement to the gear mechanism; and a reed mounted within the cavity and having an end contacting the wheel peripheral surface;

whereby in response to rotational movement of the gear mechanism each of the moveable members oscillates while the relative movement between the reed and the wheel irregular peripheral surface generates a sound.

* * * * *